United States Patent [19]

von Bonin et al.

[11] 4,148,653

[45] Apr. 10, 1979

[54] RESTRAINING LAYER FOR RETARDING THE DIFFUSION OF HYDROXYL IONS IN THE DYE DIFFUSION TRANSFER PROCESS

[75] Inventors: Wulf von Bonin; Erich Wolff; Werner Krafft; Günther Matschke, all of Leverkusen, Fed. Rep. of Germany

[73] Assignee: AGFA-Gevaert AG, Leverkusen, Fed. Rep. of Germany

[21] Appl. No.: 758,579

[22] Filed: Jan. 12, 1977

[30] Foreign Application Priority Data

Jan. 17, 1976 [DE] Fed. Rep. of Germany ..... 2601653

[51] Int. Cl.[2] ..... G03C 1/40; G03C 5/54; G03C 7/00; B44D 1/09

[52] U.S. Cl. ..... 96/77; 96/3; 96/29 D; 96/119 R; 428/412; 428/425; 428/480; 428/481; 428/483

[58] Field of Search ..... 96/3, 29 D, 77, 119 R, 96/73, 74; 428/412, 425, 480, 481, 483

[56] References Cited

U.S. PATENT DOCUMENTS

| | | | |
|---|---|---|---|
| 2,948,691 | 8/1960 | Windemuth et al. | 260/2.5 |
| 3,362,819 | 1/1968 | Land | 96/3 |
| 3,421,893 | 1/1969 | Taylor | 96/29 D |
| 3,455,686 | 7/1969 | Farney et al. | 96/77 |
| 3,615,422 | 10/1971 | Hablerin | 96/77 |
| 3,730,718 | 5/1973 | Danhauser et al. | 96/29 D |

FOREIGN PATENT DOCUMENTS

| | | |
|---|---|---|
| 2,019,430 | 11/1971 | Fed. Rep. of Germany. |
| 2,319,723 | 11/1973 | Fed. Rep. of Germany. |

OTHER PUBLICATIONS

"Neutralizing Materials in Photographic Elements", *Research Disclosure* #12331, 7/1974.

*Primary Examiner*—Richard L. Schilling
*Attorney, Agent, or Firm*—Connolly and Hutz

[57] ABSTRACT

A restraining layer capable of retarding the diffusion of hydroxyl groups is of particular use in a neutralization system for the dye diffusion transfer process. The restraining layer of the invention comprises a film-forming linear polymer consisting of alternating hydrophilic and hydrophobic segments joined to one another by carbonate, urethane and/or ester groups. The neutralization system provides retarded reduction of pH in the photographic material.

22 Claims, No Drawings

RESTRAINING LAYER FOR RETARDING THE DIFFUSION OF HYDROXYL IONS IN THE DYE DIFFUSION TRANSFER PROCESS

This invention relates to the production of color photographic images by the dye diffusion transfer process and, in particular, to a suitable polymeric restraining layer which retards the diffusion of hydroxyl ions. A restraining layer of the type in question is generally used in combination with an acid polymer layer with which it forms a so-called neutralization system. By this means, it is possible to obtain a controlled reduction in pH as a function of time within the photographic multilayer material and, in particular, within the image-receiving layer. In another embodiment of the invention a restraining layer is placed between two different color units within the photosensitive element of the photographic multilayer material to provide the possibility of individually retarding the increase of pH in the different units after the alkaline processing mass has been applied to one side of the photosensitive element.

The dye diffusion transfer process is normally carried out with a photosensitive element, which contains dye-providing compounds, and with an image-receiving element in which the required dye image is produced by the transfer of diffusible dyes to form an image. To this end, the photosensitive element and the image-receiving element have to be in firm contact at least for a finite period within the development time, so that the image-wise distribution of diffusible dyes produced in the photosensitive element as a consequence of development can be transferred to the image-receiving element. Contact may be established after development has been started, or alternatively may already have been established by the time development commences. The second of these two alternatives is adopted, for example, in cases where the material used is one in which the photosensitive element and the image-receiving element form an integral unit. In known embodiments of the dye diffusion transfer process, an integral unit such as this continues to remain intact after development is over; in other words, the photosensitive element is not separated from the image-receiving element, even after the dye has been transferred. An embodiment such as this is described, for example, in DT-OS No. 2,019,430. In another embodiment, however, the image-receiving element which carries the completed image after dye transfer may also be separated from the photosensitive element, for example by means of a stripping layer arranged between both elements. An embodiment such as this is described, for example, in U.S. Pat. No. 3,730,718.

The photosensitive element, after it has been exposed to an original to form a latent image, is then treated with an alkaline developer preparation in order to develop the silver halide and to produce an imagewise distribution of diffusible dyes which are transferred to the image-receiving element. In general, this is not followed by rinsing. However, it is necessary to reduce the high pH value achieved during development in the image-receiving layer in order definitively to fix the image dyes in the image-receiving layer and effectively to conclude development. The latter is important above all in cases where the image-receiving element and the photosensitive element together form an integral unit or a so-called mono sheet. Known measures for reducing pH include arranging in the immediate vicinity of the image-receving layer a so-called neutralization system which consists of a neutralization layer, containing a polymer with free acid groups, and of a neutralization-retarding restraining layer containing a polymer which offers a certain resistance to the diffusing hydroxyl ions. A neutralization system of this kind is described, for example, in U.S. Pat. No. 3,362,819.

If optimum results are to be obtained, particular attention must be paid to the polymer used in the restraining layer and its permeability to diffusing hydroxyl ions. The photographic material is also required to give constant results at different processing temperatures. The permeability of water-swellable and water-soluble polymer layers, for example a layer of polyvinyl alcohol, normally increases with increasing temperature. This means that, an elevated processing temperatures, the pH-reduction in the mono sheet takes place too quickly with the result that inadequate dye densities are obtained in the image-receiving layer. On the other hand, the reduction in pH slows down at excessively low processing temperatures, so that development is not completed in time. This is reflected in undesirable fogging and defective dye balance, and the dyes transferred are exposed to the alkali for too long which can result in destruction of the dyes and in "running" of the transfer image. According to U.S. Pat. No. 3,455,686 this error can be corrected by using for the restraining layer polymers with temperature-inverse permeability behaviour, i.e. polymers whose permeability to hydroxyl ions decreases with increasing temperature. Polymers such as these are described, for example, in U.S. Pat. Nos. 3,455,686 and 3,421,893.

The polymers according to U.S. Pat. No. 3,421,893 are vinyl polymers with hydrophobic and hydrophilic groups in statistical distribution. These polymers are produced either by the copolymerization of a suitable vinyl monomer mixture or by grafting vinyl amide groups onto a polyvinyl alcohol substrate. On account of the statistical distribution of the hydrophilic and hydrophobic groups resulting from their production, these polymers contain hydrophilic and hydrophobic regions of varying size and, for this reason, can only be prepared with poor reproducibility, above all in regard to their permeability behaviour. The same also applies to some of the restraining layer polymers according to U.S. Pat. No. 3,455,686 where polyvinyl alcohol, for example, is partially hydrophobized by partial acetalation.

Finally, DT-OS No. 2,319,723 describes a restraining layer in the form of a dispersion of which the continuous phase consists of a complicated copolymer of 4 monomeric units, which is substantially impermeable to the developer liquid, and of which the non-continuous phase consists of a material which is permeable to the developer liquid, for example polyacrylamide.

In this case, too, it is difficult to obtain reproducible results, especially since, in addition to the composition of the monomeric mixture, the particle size of the latex obtained also appears to be a critical factor.

The object of the present invention is to provide a restraining layer suitable for use in the dye diffusion transfer process which has precisely controllable permeability to diffusing hydroxyl ions and which, in addition, can be produced simply and with high reproducibility.

It has been found that linear polymers, in which hydrophobic and hydrophilic segments of defined size alternate with one another, are eminently suitable for this purpose.

The present invention relates to a layer retarding the diffusion of hydroxyl ions for use in the dye diffusion transfer process (hereinafter referred to simply as a restraining layer), consisting essentially of a film-forming linear polymer with a molecular weight of about 5000 to 100.000, distinguished by the fact that the linear chain of the polymer consists of alternating hydrophilic and hydrophobic segments joined to one another through carbonate, urethane or ester groups.

In contrast to the known restraining layer polymers, which contain hydrophilic and hydrophobic groups alongside one another in the same polymer molecule and where the polymers in question are vinyl polymers, the polymers according to the present invention, in addition to carbon atoms, also contain heteroatoms, especially oxygen atoms and optionally nitrogen atoms in their linear basic structure. In addition, hydrophilic and hydrophobic segments are present in the same molar frequency in the polymers according to the present invention, whereas the known polymers can contain hydrophilic and hydrophobic groups in basically any ratio. Finally, the polymers according to the invention contain hydrophilic and hydrophobic segments of defined size both by virtue of the special production conditions and by virtue of the starting materials selected. In the restraining layer according to the invention, certain required properties, for example permeability in particular for hydroxyl ions, are adjusted by varying the hydrophilic or hydrophobic components, in particular in regard to their molecular weight, or by mixing restraining layer polymers according to the invention which differ in their molecular composition. For example, the barrier action of the restraining layer can be improved gradually by one or more of the following:

(a) increasing the average molecular weight of the hydrophobic segments;

(b) decreasing the average molecular weight of the hydrophilic segments;

(c) if a mixture of high molecular weight and low molecular weight hydrophilic segments is used - changing the ratio of both in favour of low molecular weight hydrophilic segments.

By way of definition a hydrophilic segment is understood within this specification to be the residue of a polyalkylene glycol obtained by removal of two terminal hydroxyl groups. A hydrophobic segment is analoguously understood to be the residue of a bifunctional linear monomeric or polymeric compound of prevailing hydrophobic properties having two terminal functional groups capable of reacting with the terminal hydroxyl groups of the polyalkylene glycols to form carbonate, urethane or ester groups, and the residue is obtained from such compounds by removal of the two terminal functional groups.

The linear chain of the hydrophilic segment of the polymers according to the invention has a polyether structure in which three or more alkylene groups are separated by oxygen atoms, so that a maximum of 4 carbon atoms of an alkylene group are present between two adjacent oxygen atoms. The alkylene groups on which the polyether structure is based may be unsubstituted or substituted alkylene radicals, for example ethylene, 1,2-propylene, 1,2-butylene, 1,4-butylene, 1-chloromethyl ethylene or 1-phenyl ethylene radicals.

Suitable starting materials for the hydrophilic segments of the restraining layer polymers according to the invention are polyether glycols with a molecular weight of from 150 to 20.000, preferably from 150 to 5000 and more especially from 150 to 2500, produced for example from one or more of the following compounds: ethylene oxide, 1,2-propylene oxide, 1,2-butylene oxide, 1,4-butylene oxide (tetrahydrofuran), styrene oxide and epichlorhydrin.

Polyethylene glycols (polywax) with a molecular weight of up to 2500 or mixed polyether glycols of ethylene oxide with 1,2-butylene oxide, 1,4-butylene oxide, styrene oxide, epichlorhydrin or 1,2-propylene oxide, are particularly preferred. If desired, it is also possible to use mixtures of different polyether glycols for producing the restraining layer polymers according to the invention. Thus, it is not only possible to use retaining layer polymers in which the individual hydrophilic segment is derived from mixed polyether glycols but also such polymers in which two different hydrophilic segments of the same polymer are derived from different polyether glycols.

In the most simple case, the linear chain of the hydrophobic segments consists of a monomeric bifunctional organic radical, for example of an alkylene radical with at least 4 carbon atoms, an arylene radical, such as phenylene, or of a mixed aliphatic-aromatic radical such as 4,4'-diphenyl methane. However, the radical in question may also be the bifunctional radical of a linear organic polymer (prepolymer) with a molecular weight of up to 10.000, for example the radical of a linear polyester, polyamide or polyurethane. Accordingly, ester groups, amide groups or urethane groups and possibly even urea groups or ether groups may be present inside the linear chain of the hydrophobic segment. The hydrophobic character is essentially attributable to the fact that solubilizing groups, such as hydroxyl groups, such as hydroxyl groups, carboxyl groups or sulfo groups, are missing or are only present in such small quantities that the influence of the hydrocarbon groups predominates.

Suitable starting materials for the hydrophobic segments of the restraining layer polymers according to the invention are bifunctional monomeric or polymeric compounds containing two reactive groups which are able to react with the terminal hydroxyl groups of the polyether glycols, especially carboxyl groups, acid chloride groups or isocyanate groups. Examples of starting materials such as these are monomeric dicarboxylic acids and their acid chlorides, anhydrides, or esters with short-chain alcohols; diisocyanates, for example hexamethylene diisocyanate, isophorone diisocyanate, 4,4'-diphenyl methane diisocyanate, 2,4'-diphenyl methane diisocyanate, tolylene diisocyanate or dimethyl diphenyl methane diisocyanate; or reaction products of monomeric or polymeric dihydroxy or diamino compounds with excess phosgene or diisocyanate. In this way, it is possible, for example, to obtain diisocyanate prepolymers or bis-chloroformic acid esters of glycols.

When these starting materials are reacted with the polyether glycols, the hydrophilic and hydrophobic segments are attached to one another, an ester, urethane or carbonate bond being formed between a hydrophilic segment and a hydrophobic segment. In each case, an oxygen atom of the above-mentioned bonds faces the hydrophilic segment. Accordingly, the products may be referred to as polyesters, polycarbonates or polyurethanes, depending upon the type of bonds. With regard to their production, the products polyesters, polycarbonates and polyurethanes are known, for example, reference is made to Houben-Weyl, Methoden der organischen Chemie, VOL. XIV/2 (1963) wherein the preparation of polyurethanes, polyesters and polycarbonates can be effected by the processes described as follows:

Polyurethanes nearly exclusively are prepared by addition of di- or polyhydroxy compounds to di- or polyisocyanates; the addition proceeds easily and quantitatively. The preparation by condensation reactions in practice is without importance.

In the polyaddition reaction there are also formed sometimes, whether or not intended, carbonamide, urea, biurete, allophanate and isocyanurate structures. Therefore, the polyurethanes could be named more correctly as polyisocyanate-adducts.

(a) Preparation of Polyurethanes by Polyaddition

1. Basic principles of the method

The preparation of polyisocyanate-adducts was found in 1937 in the so called polyurethane- or diisocyanate-polyaddition method by O. Bayer and coworkers in the Leverkusen plant of the former I. G. Farbenindustrie AG and consists in a reasonable extension of the chemistry of monoisocyanates onto polyfunctional compounds.

It is known that isocyanates react with nearly all compounds having reactive hydrogen atoms such as alcohols, mercaptanes, amines, amides, urethanes and others. The reactions proceed with shift of hydrogen according to the following scheme:

$$R-N=C=O+HX \longrightarrow R-NH-CO-X$$

$$X = OR, SR, NH_2, NHR, NR_2, NH-COR,$$

$$N\begin{matrix} COR \\ COR \end{matrix}, \quad HC\begin{matrix} COOR \\ COOR \end{matrix} \quad \text{u.a.}$$

Isocyanates react also with water or carboxylic acids, while at the same time carbon dioxide is split off:

$$2R-N=C=O+H_2O \rightarrow R-NH-CO-NH-R+CO_2$$

$$R-N=C=O+R'-COOH \rightarrow R-NH-CO-R'+CO_2$$

This provides a great number of addition reactions of which the addition of polyhydroxy compound to di- and polyisocyanates is the most important one.

Polyhydroxy compounds can be made in a great number of ways. Their reactions with isocyanates proceed with great evolution of heat and practically quantitatively thereby yielding products which contain the urethane group as hydrophobic linking member.

Addition of aliphatic glycols to aliphatic diisocyanates results in linear polyurethane having a molecular weight of up to 12–15,000.

$$HO-R-OH+OCN-R'-NCO+HO-R-OH+OCN-R'-NCO+HO-R-OH \downarrow$$

$$-O-R-O-CO-NH-R'-NH-CO-O-R-O-CO-NH-R'-NH-CO-O-R-O-$$

Formation of linear polyurethanes

The polyaddition occurs already on mixing glycols with diisocyanates in an exothermic reaction with formation of high molecular weight polyurethanes. Depending on the ratio of the quantities used and the experimental conditions the molecular weight of the products may be varied between certain limits. For obtaining high molecular weights of up to about 14,000 to 15,000 it is required to react the glycols and the diisocyanates in the ratio of equivalent amounts. Moreover, the starting components must be pure and completely free of monofunctional chain-breaking compounds. The reaction condition must be so chosen that during reaction no disturbing side reactions that would lead to branching of the linear chains may take place. Such branchings for example are possible by reaction of isocyanate groups still present with urethane groups already formed. By such reactions chain branchings are formed via substituted allophanates with shift of hydrogen. This reaction is observed particularly when reactive aromatic diisocyanates are used (refer to p. 81). With the more slowly reaction aliphatic diisocyanates this reaction becomes unimportant.

Among the aliphatic polyurethanes the polyaddition product obtained from 1,4-butanediol and hexamethylene-diisocyanate is of technical interest. It has a melting point of 184° C. and is useful for the preparation of fibers and bristles as well as injection-molding compositions.

Substitution of 1,4-butane by glycols having a longer hydrocarbon-chain or such glycols wherein the hydrocarbon chain is interrupted by heteroatoms such as oxygens or sulfur leads if the same diisocyanate is used, to products of lower melting points. Also branched glycols which for example contain methyl groups as side chains behave in the same way. Also when aromatic compounds containing aliphatically bonded hydroxyl groups such as 1,4-bis-(γ-hydroxypropyl)-benzene, 1,4-bis-(β-hydroxyethyl)-benzene and 2,2-bis[p-(β-hydroxyethyl)-phenyl]-propane are used, stringy products are obtained on reaction with diisocyanates. In the Table 3, page 72 of the above-mentioned Houben-Weyl treatise the melting points of various polyurethanes are given.

(b) Saturated Polyesters of Two Constituents

For the preparation of linear polyesters of two constituents, the glycols and the dicarbonic acids are of great preparative importance. The esterification, which in this instance also proceeds with a water separation, is carried out in the presence and absence of catalysts.

As such, aside from the customary esterification catalysts such as sulfuric acid or p-toluene sulfonic acid, there may be used light and heavy metal salts as well as oxides of calcium, strontium, zinc, aluminum, bismuth, iron, cobalt. Calcium chloride, strontium chloride, and zinc bromide should be mentioned as well as aluminum chloride as well as lead-(II)-oxide and mercury-(II)-oxide. There are shown to be effective, furthermore, the following metals, which either as such or in the form of their oxides or salts are added in quantities of at most about 0.05%, referring to the metal cation of the esterification:

| Metal | Added as | Metal | Added as |
|---|---|---|---|
| Mn | adipinate | Cd | adipinate |
| Zn | adipinate | Pd | (II)-adipinate |
| Sb | (III)-oxide | Fe | ferrum reductum |
| Co | (II)-adipinate | | |

Sodium hydrogen sulfate is also recommended as an esterification catalyst.

Suitable as synthesis constituents are the various glycols, such as ethylene glycol, diethylene glycol, 1,2-propane diol, 1,10-decanediol, among others, as well as aliphatic and aromatic dicarboxylic acids as well as compositions of the individual constituents.

$$(n+2)\ HO-(CH_2)_x-OH + (n+1)\ HOOC-(CH_2)_yCOOH$$

$$HO-(CH_2)_x-OOC-(CH_2)_y-CO[O-(CH_2)_x-OOC-(CH_2)_y-CO]_n-O-(CH_2)_x-OH(2N+2)H_2O$$

In place of the free acids, the anhydrides, acid chlorides and esters thereof may also be used. In the use of anhydrides, effective as catalysts are hydroxides of aluminum, lead, tin and antimony. The reaction of dicarboxylic acid esters with glycols proceeds, as already mentioned, with esterification. Particularly suitable have been shown to be dicarboxylic acid esters of easily volatile alcohols such as methyl, ethyl or butyl alcohol, which react with the glycols in the presence of acid or basic catalysts with the separation of the easily volatile alcohols:

$$HO-(CH_2)_x-OH + ROOC-(CH_x)_y-COOR \rightarrow \text{polyester} + R\ OH$$

Mineral acids, such as hydrochloric acid, sulfuric acid and phosphoric acid, may be employed as the acid catalysts. Particularly suitable is the p-toluene sulfonic acid.

(c) Preparation of Polycarbonates by Phosgenation

The phosgenation methods are considered above all for the polycarbonate types soluble in customary solvents. Insoluble polycarbonates may indeed be prepared also in such a manner. However, usually nonuniform products having a low molecular weight are obtained. Since the phosgenations generally occur at temperatures of about room temperature, they are particularly saving and indispensable everywhere where esterification reactions separate out due to the thermal sensitivity of the polycarbonates to be produced or where the preparation of particularly high-molecular products is of importance.

Compared with corresponding conventional polymers, the restraining layer polymers according to the invention have an improved restraining effect with reproducible properties, especially in regard to blocking time, restraining time, dependence upon temperature and dependence upon layer thickness. The restraining layer polymers according to the invention are used with particular advantage as primary constituents of a restraining layer for the controlled retardation of the diffusion of hydroxyl ions in the dye diffusion transfer process.

By means of the restraining layer according to the invention which has the required permeability behaviour to hydroxyl ions, it is possible to build up neutralization systems which, when used in photographic materials for the dye diffusion transfer process, allow in a particularly effective manner the development of the photosensitive layers and the build up of the dye image in the image-receiving layer to proceed over a first period of time by maintaining a first (high) pH value, and thereafter over a second very short period of time, which is preferably less than half as long as the first period, bring about a reduction in pH to a second (lower) pH value at which the development and diffusion of the dyes can no longer take place. It is of critical importance that the change from the high pH value to the lower pH value should take place as quickly as possible. The particular pH-values in question are governed by the particular type of silver halide emulsions used, by the reversal process used and by the type of dye-providing compounds used. In general, the first pH value is above 11, in some cases above 12 and preferably between 13 and 14, whilst the second pH value is generally below 9. Depending upon the type of solubilising groups in the diffusible dyes, a reduction in pH to below 8, for example, and in some cases even to below 7, is required for definitively fixing the dyes.

In addition, the polymers suitable for use in accordance with the invention have the favourable property that their permeability to diffusing hydroxyl ions is largely independent of temperature or is even temperature-inverse, depending upon their composition. In other words, the blocking time is largely independent of the processing temperature or increases slightly with increasing temperature.

The neutralisation system according to the invention may be used in an image receiving layer for the dye diffusion transfer process in cases where the image receiving element and the photosensitive material are separated from one another on completion of development. However, the preferred and principal application is in dye diffusion transfer materials of the integral type, i.e. in monosheet materials in which the image receiving element and the photosensitive element are not separated from one another.

A monosheet material suitable for carrying out the dye diffusion transfer process in accordance with the invention contains the following layer elements for example:

(1) a transparent layer support,
(2) an image-receiving layer,
(3) a light-impermeable layer,
(4) a photosensitive element with at least one photosensitive silver halide emulsion layer and at least one dye-providing compound associated therewith,
(5) a restraining layer,
(6) an acid polymer layer,
(7) a transparent layer support.

The monosheet material may be formed by separately producing two different parts, namely the photosensitive part (layer elements 1 to 4) and the cover sheet (layer elements 5 to 7) which are then placed with the layer sides one on top of the other and joined together, optionally with spacer strips in between, so that a space for receiving a precisely measured quantity of a processing liquid is formed between the two parts. Additionally or alternatively the layer elements 5 and 6 which together form the neutralisation system may also be arranged, albeit in the reverse order, between the layer support and the image-receiving layer of the photosensitive part.

Means may also be provided for introducing a processing liquid between two adjacent layers of the monosheet material, for example in the form of a laterally arranged splittable container which, under the action of mechanical forces, releases its contents between two adjacent layers of the monosheet material, in the prsent case preferably between the photosensitive part and the cover sheet. A relatively high pH-value (about 11 to 14) is adjusted in the photosensitive material by the alkaline liquid and preferably viscous processing mass, thereby initiating development and imagewise diffusion of the dyes. It has been found that the dyes and layer assemblages and hence the images obtained are not especially stable at this high pH value. Accordingly, the material has to be made substantially neutral or weakly acid on completion of development. This result is achieved in known manner by additionally incorporating in the material the acid polymer layer which only becomes gradually accessible during development to the alkaline processing mass. In the context of the invention, an acid polymer layer is a layer of binder which contains polymeric compounds with acid groups, preferably sulpho groups or carboxyl groups. These acid groups react with the cations of the processing mass to form salts and, in doing so, reduce the pH-value of the mass. The polymeric compounds and hence the acid groups are, of course, incorporated in non-diffusible form in the abovementioned layer. In many cases, the acid polymers are derivatives of cellulose or derivatives of polyvinyl compounds, although it is also possible to use other polymeric compounds. Suitable acid polymers are, for example, cellulose derivatives with a free carboxyl group, for example cellulose dicarboxylic acid semiesters with a free carboxyl group, such as cellulose acetate hydrogen phthalate, cellulose acetate hydrogen glutarate, ethyl cellulose acetate hydrogen succinate, cellulose acetate hydrogen succinate hydrogen phthalate, ethers and esters of cellulose which have been modified with other dicarboxylic acid anhydrides or with sulphonic acid anhydrides, for example with o-sulphobenzoic acid anhydride, carboxymethyl cellulose, also polystyrene sulphonic acid, polyvinyl hydrogen phthalate, polyvinyl acetate hydrogen phthalate, polyacrylic acid, acetals of polyvinyl alcohol with aldehydes substituted by carboxy groups or sulpho groups, such as o-, m- or p-benzaldehyde sulphonic acid or carboxylic acid, partially esterified ethylene-maleic acid anhydride copolymers, partially esterified methyl vinyl ether/maleic acid anhydride copolymers. This acid polymer layer must contain enough acid groups to reduce the pH value of the processing mass from, initially 11–14 to such an extent that, ultimately, the material is substantially neutral or weakly acid (pH-value 5 to 8). The delay in pH-reduction layer with the so-called restraining layer. According to the present invention, the restraining layer consists essentially of a linear film-forming polymer with a molecular weight of from about 5000 to 100,000, of which the chain consists of alternating hydrophilic and hydrophobic segments attached to one another through carbonate, urethane or ester connecting groups, and together with the acid polymer layer forms the neutralisation system according to the present invention. It is obvious that for this purpose, the restraining layer has to be arranged between the acid polymer layer and the image-receiving layer within the layer structure. The restraining layer according to the invention is preferably produced by casting the corresponding polymers from aqueous or organic solution, followed by drying. The thickness of the restraining layer is governed by the required restraining time (development time) and generally amounts to between 2 and 20 $\mu$.

An important part of the photographic materials suitable for the dye diffusion transfer process is the photosensitive element which, in the case of a single dye diffusion transfer process, contains a photosensitive silver halide emulsion layer and, in association therewith, a dye-providing compound. This compound may be situated in a layer adjacent the silver layer itself. In the latter case, the colour of the image dye is preferably selected in such a way that the predominant absorption range of the dye-providing compound does not coincide with the predominant sensitivity range of the silver halide emulsion layer. In order to produce multicolour transfer images in natural colours, however, the photosensitive element contains three colour units each unit comprising such an association of dye-providing compound and photosensitive silver halide emulsion layer, the absorption range of the dye-providing compound generally coinciding to a large extent with the spectral sensitivity range of the associated silver halide emulsion layer. In this case, however, it is essential, if maximum sensitivity is to be obtained, for the particular dye-providing compound to be arranged in a separate binder layer behind the silver halide emulsion layer (looking in the direction of the incident light during exposure). As actually only the final dye must coincide with respect to its absorption range with the sensitivity range of the silver halide to which its parent dye-providing compound is associated it is of course not necessary to incorporate the dye-providing compound with a separate layer if it by itself has an absorption range which is different from that of the dye provided from it.

The developer oxidation products formed during the development of a silver halide emulsion should, of course, act only on the associated dye-providing compound. Accordingly separation layers are generally present in the photosensitive element, effectively preventing the developer oxidation products from diffusing into other non-associated layers. These separation layers may contain, for example, suitable substances which react with the developer oxidation products, for example non-diffusible hydroquinone derivatives or, when the developer compound is a colour developer compound, non-diffusible colour couplers.

In principle, compounds of any kind which give diffusible dyes during development of the photosensitive element are suitable as dye-providing compounds. The compounds in question may be coloured compounds which are themselves diffusible and which, when the layers are treated with an alkaline processing liquid, begin to diffuse and are only fixed by development in the exposed areas. However, the dye-providing compounds may also be diffusion-stable, releasing a diffusible dye in the course of development.

Dye-providing compounds which a priori are diffusible are known, for example, from German Patent Specifications Nos. 1,036,640; 1,111,936 and 1,196,075. The so-called dye developers described there contain in the same molecule a dye radical and a group which is capable of developing exposed silver halide.

Among conventional processes for producing coloured photographic images on the dye diffusion transfer principle, increasing significance has recently been acquired by those processes which are based on the use of dye-providing compounds which are incorporated in non-diffusible form and from which diffusible dyes or dye precursors are split off imagewise during development and transferred to an image-receiving layer.

Dye-providing compounds suitable for this purpose include, for example, the non-diffusible colour couplers described in U.S. Pat. No. 3,227,554 which release a preformed dye or a dye produced during colour coupling in diffusible form during development in consequence of a reaction with the oxidation product of a colour development compound consisting of a primary aromatic amine. The choice of the developer compound required is, of course, confined to colour developers.

In addition, reference is made in this connection to the non-diffusible dye-providing compounds described in U.S. Pat. No. 3,628,952 which contain a preformed latent diffusible dye radical attached to a diffusion-resistent radical through a removable hydrazone group. These compounds cannot be called colour couplers, and it has been found that the choice of developer compounds required for liberating the diffusible dye radical is by no means confined to the usual colour developers. Instead, black-and-white developers, for example pyrocatechols, are also eminently suitable.

In addition, U.S. Pat. Nos. 3,443,939 and 3,443,940 describe non-diffusible coloured compounds with a special group which, during development, enters into an oxidative ring-closing reaction and, in doing so, liberates a preformed dye radical in diffusible form. The compounds envisaged there may be divided into two groups. The compounds of one group require for development one of the usual colour developer compounds with whose oxidation product they couple and, in a subsequent ring-closing reaction, liberate the preformed dye radical in diffusible form. The compounds of the other group are themselves silver halide developers and, accordingly, are able in oxidised form, even in the absence of other developer compounds, to enter into the above-mentioned ring-closing reaction with liberation of the diffusible dyes.

Finally, reference is also made at this juncture to the non-diffusible dye-providing compounds according to DT-OS No. 2,242,762. These compounds are sulphonamidophenols and sulphonamidoanilines which, after the oxidation reaction which takes place during development, are split under the effect of the developer alkali with the liberation of diffusible dyes.

The dye-providing compounds mentioned above all work in the negative sense. In other words, in cases where conventional (negatively working) silver halide emulsions are used, the imagewise distribution of the diffusible dye liberated is formed in consistency with the negative silver image produced during development. In order to produce positive dye images by using such compounds, therefore, it is necessary to use direct-positive silver halide emulsions or otherwise a suitable reversal process.

A suitable reversal process is available in the silver salt diffusion process. The photographic reversal by means of the silver salt diffusion process to form positive coloured images using conventional colour couplers is described, for example, in U.S. Pat. No. 2,763,800. Exchange of the colour couplers for the dye-providing compounds mentioned gives a photosensitive element which is suitable for the dye diffusion transfer process. A photosensitive element of this kind comprises, for example, at least one combination of a photosensitive silver halide emulsion layer and, in association therewith, a binder layer which contains development nuclei for the physical development process and a dye-providing compound.

During development, the exposed part of the silver halide is chemically developed in the photosensitive silver halide emulsion layer. The unexposed part is transferred by means of a silver halide solvent into the associated binder layer containing development nuclei where it is physically developed. In cases where the physical development process is carried out with a developer which is able in oxidised form to liberate a diffusible dye in consequence of a cross oxidation or a coupling reaction with the dye-providing compound present in that layer, an imagewise distribution of diffusible dyes is formed and is transferred to an image receiving layer where it forms a positive coloured image.

In cases where reversal is carried out with compounds which split off development inhibitors in imagewise manner, the photosensitive element consists of at least one layer combination of a photosensitive silver halide emulsion layer and of a second emulsion layer which can be developed without exposure and which contains the dye-providing compound. The photosensitive silver halide emulsion layer is developed, for example, with colour developers in the presence of certain compounds which, during the reaction with oxidised colour developer, split off development-inhibiting substances. The development-inhibiting substances liberated imagewise in the photosensitive layer diffuse into the adjacent emulsion layer which can be developed without exposure and in which they inhibit development in imagewise manner. The non-inhibited (positive) parts of the emulsion layer which can be developed without exposure are developed by the residual developer whose oxidation products subsequently react with the non-diffusible dye-providing compounds with liberation of diffusible dyes which are transferred imagewise to the image-receiving element. Suitable compounds, which split off development-inhibiting substances on reaction with colour developer oxidation products, are for example the known DIR (DIR = development inhibitor releasing) couplers which are colour couplers containing a releasable inhibitor radical in the coupling position. DIR couplers such as these are described, for example, in U.S. Pat. No. 3,227,554.

Another group of compounds which liberate development-inhibiting substances on reaction with colour developer oxidation products is described in U.S. Pat. No. 3,632,345. The compounds in question are not colour couplers. Accordingly, no dyes are formed when the development-inhibiting substances are liberated. Very similar compounds are also described in DT-OS No. 2,359,295. Finally, according to DT-PS No. 1,229,389, it is also possible to use in a process of the kind in question suitable substituted non-diffusible hydroquinone compounds which, on reaction with developer oxidation products, are oxidised to form the corresponding quinones and, at the same time, liberate development-inhibiting mercaptans.

In principle, suitable direct positive silver halide emulsions include any direct positive silver halide emulsions which, in the event of simple development, produce a positive silver image and an imagewise distribution of developer oxidation products corresponding to that silver image. It is possible to use, for example, silver halide emulsions of the type where exposure to light or chemical treatment has produced a developable fog which, under certain conditions, is destroyed imagewise during imagewise exposure. The fog remains intact in the unexposed areas so that subsequent development gives a direct positive silver image and, in consistency therewith, an imagewise distribution of diffusible dye when a dye-providing compound is associated with the direct positive silver halide emulsion.

Another group of direct positive silver halide emulsions which are used with advantage in accordance with the invention, comprises the so-called non-fogged direct-positive silver halide emulsions which show photosensitivity predominantly inside the silver halide grains. When emulsions of this type are exposed imagewise, a latent image is formed predominantly inside the silver halide grains. However, the development of non-fogged direct positive silver halide emulsions of this type is carried out under fogging conditions, a fog being produced primarily in the unexposed areas and a positive silver image being developed during development.

The selective fogging of the non-fogged direct positive emulsions which have been exposed to form an image may be carried out before or during development by treatment with a fogging agent. Suitable fogging agents are reducing agents such as hydrazine or substituted hydrazines. Reference is made, for example, to U.S. Pat. No. 3,227,552.

Non-fogged direct-positive emulsions are, for example, those which show faults inside the silver halide grains (U.S. Pat. No. 2,592,250) or silver halide emulsions with a layered grain structure (DT-OS No. 2,308,239).

Another possibility of producing positive dye transfer images by use of usual negative silver halide emulsions consists in the use of dye-providing compounds which in unoxidised state are split by developer alkali to release diffusible dyes but which when oxidised are not or only to a lesser extent subject to that splitting reaction. Such dye-providing compounds are described for example in DT-OS No. 2,402,900 and DT-OS No. 2,543,902.

The light-impermeable layer arranged below the photosensitive element is permeable to aqueous alkaline treatment solutions and, hence, to the diffusible dyes. It performs essentially two functions. Firstly, it masks the image silver left after development in the originally photosensitive element and also the colouring compounds left behind as colour negative, so that only the positive dye transfer image is visible through the transparent layer support of the photosensitive part. Secondly, it prevents light to come into the photosensitive element from the side of the image-receiving layer (from underneath). This second function is of particular importance when, after exposure, the monosheet material is intended to be brought into contact with the alkaline processing mass inside the camera, subsequently removed from the camera and developed outside it, in daylight.

Layers which are impervious to light, but have adequate permeability to diffusible dyes may be produced, for example, with suspensions of inorganic or organic dark, preferably black pigments, for example with suspensions of carbon black in suitable binders, for example in gelatin solutions. In general, it is sufficient to produce 0.5 to 2$\mu$ thick layers containing from 10 to 90% by weight (based on the total dry weight) of carbon black in gelatin in order adequately to guarantee the exclusion of light during development. The particle size of the pigments used is relatively non-critical providing it does not exceed 0.5$\mu$ to any significant extent.

In addition to the black pigment layer, the light-impermeable layer also comprises a white pigment layer arranged below the black pigment layer. The function of this white pigment layer is to cover the black layer and to provide a white background for the image. Any white pigment may be used for this purpose providing it has adequate covering power in reasonable layer thicknesses. Suitable white pigments are, for example, barium sulphate, oxides of zinc, titanium silicon, aluminium and zirconium, and also barium stearate or kaolin. Titanium dioxide is preferably used as the white pigment. The requirements which the white pigment has to satisfy in regard to the binder, concentration and particle size are the same as for the black pigment. The thickness of the white pigment layer may be varied according to the whiteness of the background. Layer thickness of from 2 to 10$\mu$ are preferred.

Instead of the light-impermeable layer, the monosheet material may also contain, in accordance with the invention, means for producing such a light-impermeable layer arranged between the photosensitive element and the image-receiving layer, for example in the form of a laterally arranged container which is filled with a processing liquid containing an opacifier (pigment) and which, under the action of mechanical forces, releases its contents between the above-mentioned layers so that a pigment layer of the kind in question is formed there.

The image-receiving layer consists essentially of a binder containing dye mordants for fixing the diffusible acid dyes.

Preferred mordants for acid dyes are long-chain quaternary ammonium or phosphonium compounds or tertiary sulphonium compounds, for example those of the type described in U.S. Pat. Nos. 3,271,147 and 3,271,148.

It is also possible to use certain metal salts and their hydroxides which form substantially insoluble compounds with the acid dyes. In the receiving layer the dye mordants are dispersed in one of the usual hydrophilic binders, for example in gelatin, polyvinyl pyrrolidone are totally or partially hydrolysed cellulose esters. Some binders may, of course, also function as mordants, for example copolymers or polymer mixtures of vinyl alcohol and N-vinyl pyrrolidone of the type described, for example, in DT-AS No. 1,130,284, and also those which are polymers of nitrogen-containing quaternary bases, for example polymers of N-methyl-2-vinyl pyridine as described, for example, in U.S. Pat. No. 2,484,430. Other suitable mordant binders are, for example, guanyl hydrazone derivatives of alkyl vinyl ketone polymers as described, for example, in U.S. Pat. No. 2,882,156, or guanyl hydrazone derivatives of acyl styrene polymers as described, for example, in DT-AS No. 2,009,498. In general, however, other binders, for example gelatin, will be added to these mordant binders.

Suitable transparent layer supports for the monosheet material according to the invention are the transparent supporting materials normally used in photography, for example films of cellulose esters, polyethylene terephthalate, polycarbonate or other film-forming polymers.

For processing, the photosensitive element is treated after exposure to form an image with an aqueous-alkaline developer preparation and is brought into contact with the image-receiving element. In the case of monosheet materials, the developer preparation is pressed in between two layers of the monosheet. In addition to the aqueous alkali, the developer preparation may also contain developer compounds, although these developer compounds must be adapted to the type of dye-providing compounds present. Other possible constituents of the developer preparation are thickeners for increasing viscosity, for example hydroxy ethyl cellulose, silver halide solvents, for example sodium thiosulphate, or one of the bis-sulphonyl alkane compounds described in DT-OS No. 2,126,661, or opacifiers for producing opaque layers, for example pigments of $TiO_2$, ZnO, barium stearate or kaolin. Alternatively or in addition, some of these constituents may also be incorporated in one or more layers of the sheet materials. Thus, in one particularly preferred embodiment for example, non-diffusible developer compounds are incorporated in layers of the photosensitive element, whereas the developer preparation itself only contains small quantities of a diffusible auxiliary developer compound. Reference is made in this connection to DT-OS No. 2,327,963 and DT-OS No. 2,335,175.

In the case described above, the function of the restraining layer according to the invention is to reduce the pH value in a part of the layers of a colour photographic multilayer material, especially in the image-receiving layer or in the photosensitive layers, after a certain contact time. This result is obtained particularly easily in cases where the restraining layer according to the invention is combined with an acid polymer layer to form a so-called neutralisation system, which represents a preferred embodiment of the present invention. A neutralisation system of this kind, consisting of an acid polymer layer and of a restraining layer, may be a firm constituent of a photosensitive monosheet material for the dye diffusion transfer process, the neutralisation system being arranged for example below the image receiving layer or above the photosensitive layer element. In this case, the neutralisation system is an integral part of a photosensitive material. However, it is also possible for the neutralisation system to be situated in a non-photosensitive material and arranged on a suitable support. The neutralisation system may be accommodated, for example, in a separate cover sheet which is only brought into contact with a photosensitive material containing a photosensitive layer element and an image-receiving element after it has been exposed inside the camera. At the same time, a developer liquid may be distributed between the photosensitive material and the cover sheet.

The neutralisation system may also be accommodated in an image-receiving sheet preferably below the image-receiving layer. After exposure of the photosensitive material, the image-receiving sheet is brought into contact with it. At the same time, a developer liquid may be distributed between the photosensitive material and the image-receiving sheet. In either case, however, the neutralisation system is used by definition during the development of the colour photographic material.

However, the restraining layer according to the invention is also suitable for retarding the adjustment of a high pH-value in a part of the layer assemblage. This can be of importance above all in cases where it is desired to initiate development operations one after the other in different parts of the photosensitive material. This can be of importance especially in cases where dye developers are used. In this case, the restraining layers according to the invention are advantageously used as separation layers between different colour units of multilayer photosensitive elements.

EXAMPLE 1

General Procedure for Producing the Polymers According to the Invention

A suitable polyether glycol or a mixture of several such polyether glycols is dissolved in approximately 10 to 20 times the quantity of methylene chloride, an equivalent quantity of diisocyanate (for example 4,4'-diphenyl methane diisocyanate) is added and the mixture is stirred until a solution is formed. A basic catalyst, for example diazabicyclooctane (Dabco), is added in a quantity of from about 0.3 to 0.5% by weight, based on the polyether glycol, followed by boiling under reflux for 8 hours. Approximately 10% by weight of methanol, based on the polyether glycol, are then added and the mixture is allowed to boil for another hour. The solution obtained may immediately be cast to form the restraining layer.

| | Preparation Examples (quantities in g) | | |
|---|---|---|---|
| methylene chloride | 687 | 531 | 507 |
| tetraethylene glycol | 60 | 27 | 18 |
| polyethylene oxide 2000 | 30 | 63 | — |
| polyethylene oxide 1350 | — | — | 72 |
| 4,4'-diphenyl methane diisocyanate | 81.15 | 42.72 | 36.64 |
| diazabicyclooctane | 0.3 | 0.3 | 0.3 |

EXAMPLE 2

The following layers were applied by dip-coating to a transparent polyethylene terephthalate film:

1. A bonding layer according to U.S. Pat. No. 3,794,513 in the form of a solution of:

10 ml of polymethacrylic acid methyl ester(molecular weight approximately 100,000) (10% in $CHCl_3$)

17.5 g of chloral hydrate 30 ml of chloroform 50 ml of dichloroethane 0.1 ml of silicon oil PN 200 (10% in $CH_2Cl_2$); this is a polyphenyl methyl siloxane and is marketed by Bayer AG, Leverkusen;

2. An acid polymer layer consisting of a copolymer of acrylic acid and butyl acrylate in a mixing ratio of 45:55 in a layer thickness of approximately 28$\mu$;

3. Restraining layers with polymers having different compositions produced by reacting tetraethylene glycol, polyethylene oxide (MW = 2000) and 4,4'-diphenylmethane diisocyanate in the mixing ratios shown in the following Table. The thickness of the restraining layer is also shown in the Table.

A transparent cover film was placed on the layer assemblage described above and an indicator paste with the following composition was pressed in between the layer assemblage and the cover film in a thickness determined by spacer strips of 126 $\mu$m.

Indicator paste:

100 ml of water 3.5 g of Natrosol HHR (highly viscous hydroxy ethyl cellulose)

2.5 g of NaOH 0.1 g of dye corresponding to the formula:

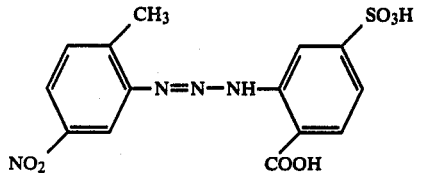

The time required for decoloration is a measure of the permeability behaviour of the restraining layer. In the Table, two time values are quoted in minutes in each case. The first corresponds to the beginning of decoloration and the second to the complete change of colour.

Table

| | Polymer (composition in g) | | |
|---|---|---|---|
| | I | II | III |
| tetraethylene glycol | 64.5 | 60 | 57 |
| polyethylene oxide 2000 | 25.5 | 30 | 33 |
| diphenyl methane diisocyanate | 86.4 | 81.2 | 77.7 |
| layer thickness [ μ ] | 3 5 | 3 | 3 |
| decoloration time [mins] | 22/27 35/42 | 2.2/3.0 | 1.0/1.5 |

EXAMPLE 3

A monosheet material for the dye diffusion transfer process was made up from an image element A and a cover sheet B:

(A) Image element consisting of an image-receiving layer with a dye mordant, a light-reflecting layer and a photosensitive structure.

The following layers were successively applied to a transparent polyester film support:

1. A gelatin layer with 4 g/m$^2$ of octadecyl trimethyl ammonium methyl sulphate as mordant, layer thickness 10 μm;

2. A gelatin layer with 50 g/m$^2$ of titanium dioxide treated with $SiO_2$ aquate-$Al_2O_3$ aquate (cf. DT-OS 2,324,590) as light-reflecting layer, layer thickness 15 μm;

3. A gelatin layer with 0.8 g/m$^2$ of the cyan component L (see attached formula sheet) and 0.6 g/m$^2$ of the non-diffusible colour developer 2-amino-5-(N-dodecyl-N-ω-sulphopropylamino)-toluene; layer thickness 2 μm;

4. A gelatin layer with a red-sensitised, non-fogged direct-positive silver chloride bromide emulsion, silver coverage 1.8 g/m$^2$, layer thickness 1 μm;

5. A gelatin layer with 0.5 g/m$^2$ of octadecyl hydroquinone sulphonic acid as blocking layer for oxidised auxiliary developer, layer thickness 2 μm;

6. A gelatin layer with 0.8 g/m$^2$ of the magenta component M (see attached formula sheet) and 0.6 g/m$^2$ of the non-diffusible colour developer 2-amino-5-(N-dodecyl-N-w-sulphopropylamino)toluene, layer thickness 2 μm;

7. A gelatin layer with a green-sensitised, non-fogged direct positive silver chloride bromide emulsion, silver coverage 1.8 g/m$^2$, layer thickness 1 μm;

8. A blocking layer for oxidised auxiliary developer (identical with layer 5);

9. A gelatin layer with 0.8 g/m$^2$ of the yellow component N (see attached formula sheet) and 0.6 g/m$^2$ of the non-diffusible colour developer 2-amino-5-(N-dodecyl-N-ω-sulphopropylamino)toluene, layer thickness 2 μm;

10. A gelatin layer with a blue-sensitized, non-fogged direct-positive silver chloride bromide emulsion, silver coverage 1.8 g/m$^2$, layer thickness 1 μm;

11. A gelatin protective layer, layer thickness 1 μm;

(B) Cover sheet; the following layers were applied by dipcoating to a transparent film of polyethylene terephthalate:

1. A bonding layer according to U.S. Pat. No. 3,794,513 in the form of a solution of:

10 ml of polymethacrylic acid methyl ester (molecular weight approximately 100,000) (10% in $CHCl_3$)

17.5 g of chloral hydrate 30 ml of chloroform 50 ml of dichloroethane 0.1 ml of Silikonol PN 200 (10% in $CH_2Cl_2$); Silikonol PN 200 is a polyphenyl methyl siloxane and is marketed by Bayer AG, Leverkusen;

2. An acid polymer layer consisting of a copolymer of acrylic acid and acrylic acid butyl ester in a mixing ratio of 45:55 in a layer thickness of approximately 28 μ;

3. A restraining layer for OH ions produced with a polymer of 63 g of tetraethylene glycol, 27 g of polyethylene oxide (MW 2000) and 84.6 g of 4,4'-diphenyl methane diisocyanate; layer thickness 3.5 μm.

A strip of the image element (A) was exposed through a colour separation wedge and was subsequently united on the layer side with the cover sheet (B) to form an image set in conjunction with a paste bag at one end of the image strip and using two laterally arranged spacer strips which were 250 μm thick and 0.5 cm wide.

A paste of the following composition was used as a developer:

2 g of sodium sulphite 15 g of potassium hydroxide, 10 ml of benzyl alcohol, 1 g of N,N,N',N'-tetramethyl-p-phenylene diamine, 1 g of acetyl phenyl hydrazine, and 35 g of hydroxy ethyl cellulose, made up with water to 1 liter.

The image set was passed through a pair of squeezing rolls, as a result of which the developer paste was distributed between the photosensitive structure and the cover sheet in the thickness of 250 μm defined by the spacer strips. After a few minutes, a multicoloured positive image of the original with a high colour density and clear colour separation was visible through the transparent support of the image receiving layer with the $TiO_2$ layer as image background. The effect of the restraining layer on the cover sheet is that alkali neutralisation only begins after development of the negative and imagewise release of the dyes, so that the required high colour density is obtained in the image receiving layer.

EXAMPLE 4

Photosensitive Element with Image-Receiving and Reflection Layer (1)

The following layers (amounts per square meter) were applied in the following order to a transparent film support of polyethylene terephthalate:

1. An image receiving layer of 3.8 g of octadecyl trimethyl ammonium monomethyl sulphate and 9.5 g of gelatin;

2. An opaque light-reflecting layer, permeable to alkaline working liquid, of 48.5 g of titanium dioxide and 4.85 g of gelatin;

3. A nuclear layer with 1.32 g of the compound L forming a cyan transfer dye (cf. attached formula sheet), 4.5 mg of silver sulphide seeds, 0.1 g of carbon black, 0.88 g of the developer 2-amino-5-(N-dodecyl-N-ω-sulphopropylamino)-toluene and 2.5 g of gelatin;

4. A red-sensitive silver bromide emulsion layer of 2 g of gelatin, 1.1 g of silver, 0.37 g of the developer 2-octadecyl hydroquinone and 1.23 g of the developer 2-octadecyl-5-sulphohydroquinone;

5. A separation layer of 3.9 g of gelatin and 0.18 g of the developer 2-octadecyl-5-sulphohydroquinone;

6. A nuclear layer containing 0.48 g of the compound M forming a magenta transfer dye (see attached formula sheet), 3.8 mg of silver sulphide seeds, 0.76 g of the developer 2-amino-5-(N-dodecyl-N-sulphopropylamino)-toluene and 2.1 g of gelatin;

7. A green-sensitive gelatin silver bromide emulsion layer of 2 g of gelatin, 0.7 g of silver and 1.23 g of the developer 2-octadecyl-5-sulphohydroquinone and 0.37 g of the developer 2-octadecylhydroquinone;

8. A separation layer of 2.5 g of gelatin and 0.18 g of the developer 2-octadecyl-5-sulphohydroquinone;

9. A nuclear layer containing 0.85 g of the compound N forming a yellow transfer dye (cf. attached formula sheet), 4.2 mg of silver sulphide, 0.85 g of the developer 2-amino-5-(N-dodecyl-N-ω-sulphopropylamino)-toluene and 2.4 g of gelatin;

10. A blue-sensitive gelatin-silver bromide emulsion of 2 g of gelatin, 0.9 g of silver and 1.23 g of the developer 2-octadecyl-5-sulphohydroquinone and 0.37 g of the developer 2-octadecylhydroquinone; and 11. A layer of 1.2 g of gelatin and 0.12 g of 1-phenyl-3-pyrazolidone.

Cover Sheet with Neutralisation System (2)

An acid polymer layer of the butyl semiester of an ethylene/maleic acid anhydride copolymer (as described in U.S. Pat. No. 3,362,819) was initially applied in a layer thickness of approximately 20 μ to a transparent polyethylene terephthalate film support. This was followed by the application in a layer thickness of 4.5 μm of a restraining layer containing a polymer of 60 g of tetraethylene glycol, 30 g of polyethylene oxide (MW 2000) and 81.2 g of 4,4'-diphenyl methane diisocyanate.

If, after the photosensitive element has been exposed imagewise, these two sheets are brought into contact on their layer sides and if an alkaline processing solution of the following composition is pressed between the two sheets in known manner, a multicoloured reproduction of the original on a white background is obtained after a few minutes.

The processing solution had the following composition:

25 g of NaOH,
30 g of Natrosol HHR,
4.0 g of sodium sulphite,
2.0 g of sodium thiosulphate, and
10 g of benzyl alcohol,
made up with water to 1 liter.

If the two sheets 1 + 2 are left in contact after development or if they are converted into a so-called "integral film unit" by surrounding them on all sides with a transparent adhesive tape, a very rapid reduction in pH of the paste alkali distributed in the layers of the monosheet set is obtained immediately after full development of the exposed photosensitive element. The image formed, especially the white areas thereof, is thus stabilised. In other words, these areas remain white and are not adversely affected in any way by a colour fog.

In order to obtain maximum colour densities, it is essential that the high initial pH should remain intact in the set to be developed for the time required for development of the negative. This guarantees the "blocking time" for OH ions determined by the restraining layer.

If, by contrast, the restraining layer according to the invention is replaced by a polyacrylamide-containing latex restraining layer, of the type described in DT-OS No. 2,319,723 and having the following composition: terpolymer latex of butyl acrylate/diacetone acrylamide/methacrylic acid/styrene 60/30/6/4, mixed with a high molecular weight polyacrylamide in a mixing ratio of 100:1, heavy blue fogging through alkali-induced, non-imagewise release of dye is obtained after storage for 1 to 2 hours owing to the much slower reduction in pH for the same dye transfer densities.

Formulae for Examples 3 and 4

In the following formulae, Z represents the radical:

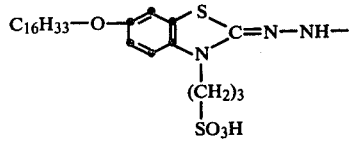

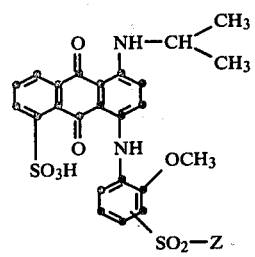

L

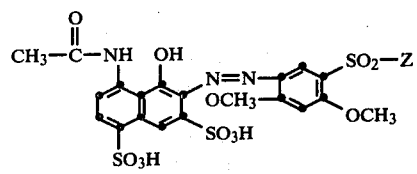

M

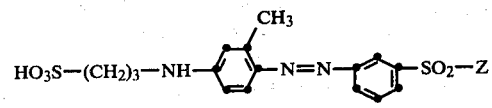

N

We claim:

1. A photographic material for the production of colored images by the dye diffusion process comprising:

(a) at least one transparent layer support
(b) an image receiving layer
(c) a light reflecting layer or means to produce such light-reflective layer
(d) a photosensitive element containing at least one color unit comprised of a photosensitive silver halide emulsion layer and a dye-providing compound associated to said photosensitive layer, said reflecting layer being located between said image receiving layer and the photosensitive element
(e) at least one restraining layer capable of retarding the diffusion of hydroxyl ions located between a first group and a second group of layers of said photographic material, said first group comprising at least one color unit of said photosensitive element (d), and (f) a rupturable container containing an alkaline processing composition and capable of discharging, on applying to it a compressive force, its content between said restraining layer and said first group of layers or between two layers of said first group of layers, wherein the improvement comprises the restraining layer consists essentially of a film-forming linear polymer of a molecular weight of from 5,000 to 100,000 and the linear chain of the polymer is comprised of alternating hydrophilic polyether segments with a molecular weight of 150 to 20,000 in which three or more alkylene groups are separated by oxygen atoms, so that a maximum of four carbon atoms are present between two adjacent oxygen atoms and hydrophobic segments formed from bifunctional organic compounds containing two reactive groups capable of reacting with the terminal hydroxyl groups of polyether glycols to form connecting members selected from the group consisting of carbonate, urethane and ester connecting members, by removal of said reactive groups, said alternating hydrophilic and hydrophobic segments being joined to one another through connecting members selected from said carbonate, urethane and ester connecting members.

2. The material as claimed in claim 1 in which in the restraining layer the hydrophilic segments of the polymer have a molecular weight of up to 5,000.

3. The material as claimed in claim 1 in which in the restraining layer the hydrophilic segment is the residue obtained by removal of two terminal hydroxyl groups from a polyalkylene glycol of one or more compounds selected from the group consisting of ethylene oxide, 1,2-propylene oxide, 1,2-butylene oxide, 1,4-butylene oxide (tetrahydrofuran), styrene oxide and epichlorohydrin.

4. The material as claimed in claim 1 in which in the restraining layer the hydrophilic segment consists of the residue obtained by removal of two terminal hydroxyl groups from a polyethylene oxide having a molecular weight of from 150 to 2,500.

5. The material as claimed in claim 1 in which in the restraining layer the hydrophilic segments are derived from two or more different poly alkylene glycols.

6. The material as claimed in claim 1 in which in the restraining layer the hydrophobic segment is a bivalent alkylene, arylene or aralkylene radical.

7. The material as claimed in claim 1 in which in the restraining layer the hydrophobic segment is the bivalent radical of a linear prepolymer selected from the group consisting of polyesters, polyurethanes, polyamides and polyureas, having a molecular weight of up to 10,000.

8. A photographic material for the production of colored images by the dye-diffusion process comprising:

(a) a first transparent layer support (b) a laminate arranged on said layer support, said laminate comprising in the following order, an image-receiving layer, a light-reflecting layer and a photosensitive element containing at least one color unit comprised of a photosensitive silver halide emulsion layer and a dye-providing compound associated to said photosensitive layer (c) a second transparent layer support (d) a neutralisation system on said second transparent support comprising an acid polymer layer and a restraining layer capable of retarding the diffusion of hydroxyl ions, said restraining layer being located between said acid polymer layer and said laminate, and (e) a rupturable container containing an alkaline processing composition and capable of discharging, on applying to it a compressive force, its content between said laminate and said neutralisation system, wherein the improvement comprises the restraining layer consists essentially of a film-forming linear polymer of a molecular weight of from 5,000 to 100,000 and the linear chain of the polymer is comprised of alternating hydrophilic polyether segments with a molecular weight of 150 to 20,000 in which three or more alkylene groups are separated by oxygen atoms, so that a maximum of four carbon atoms are present between two adjacent oxygen atoms and hydrophobic segments formed from bifunctional organic compounds containing two reactive groups capable of reacting with the terminal hydroxyl groups of polyether glycols to form connecting members selected from the group consisting of carbonate, urethane and ester connecting members, by removal of said reactive groups, said alternating hydrophilic and hydrophobic segments being joined to one another through connecting members selected from said carbonate, urethane and ester connecting members.

9. The material as claimed in claim 8 in which in the restraining layer the hydrophilic segments of the polymer have a molecular weight of up to 5,000.

10. The material is claimed in claim 8 in which in the restraining layer the hydrophilic segment is the residue obtained by removal of two terminal hydroxyl groups from a polyalkylene glycol of one or more compounds selected from the group consisting of ethylene oxide, 1,2-propylene oxide, 1,2-butylene oxide, 1,4-butylene oxide (tetrahydrofuran), styrene oxide and epichlorohydrin.

11. The material as claimed in claim 8, in which in the restraining layer the hydrophilic segment consists of the residue obtained by removal of two terminal hydroxyl groups from a polyethylene oxide having a molecular weight of from 150 to 2,500.

12. The material as claimed in claim 8 in which in the restraining layer the hydrophilic segments are derived from two or more different poly alkylene glycols.

13. The material as claimed in claim 8 in which in the restraining layer the hydrophobic segment is a bivalent alkylene, arylene or aralkylene radical.

14. The material as claimed in claim 8 in which in the restraining layer the hydrophobic segment is the bivalent radical of a linear prepolymer selected from the group consisting of polyesters, polyurethanes, polyamides and polyureas, having a molecular weight of up to 10,000.

15. A neutralisation system consisting of an acid polymer layer and a restraining layer on a transparent layer support said acid layer being more adjacent to the layer support than said restraining layer, and said system being adapted to be processed in contact with an imagewise exposed photosensitive material by passing it together with said photosensitive material between a pair of juxtaposed pressure-applying members and thereby distributing an alkaline processing composition between said neutralisation system and said photosensitive material, said restraining layer being capable of retarding the diffusion of hydroxyl ions from said processing composition into said acid polymer layer, wherein the improvement comprises the restraining layer consists essentially of a film-forming linear polymer of a molecular weight of from 5,000 to 100,000 and the linear chain of the polymer is comprised of alternating hydrophilic polyether segments with a molecular weight of 150 to 20,000 in which three or more alkylene groups are separated by oxygen atoms, so that a maximum of four carbon atoms are present between two adjacent oxygen atoms and hydrophobic segments formed from bifunctional organic compounds containing two reactive groups capable of reacting with the terminal hydroxyl groups of polyether glycols to form connecting members selected from the group consisting of carbonate, urethane and ester connecting members, by removal of said reactive groups, said alternating hydrophilic and hydrophobic segments being joined to one another through connecting members selected from said carbonate, urethane and ester connecting members.

16. The neutralisation system as claimed in claim 15 in which in the restraining layer the hydrophilic segments of the polymer have a molecular weight of up to 5,000.

17. The neutralisation system in claim 15 in which in the restraining layer the hydrophilic segment in the residue obtained by removal of two terminal hydroxyl groups from a polyalkylene glycol of one or more compounds selected from the group consisting of ethylene oxide, 1,2-propylene oxide, 1,2-butylene oxide, 1,4-butylene oxide (tetrahydrofuran), styrene oxide and epichlorohydrin.

18. The neutralisation system as claimed in claim 15 in which in the restraining layer the hydrophilic segment consists of the residue obtained by removal of two terminal hydroxyl groups from a polyethylene oxide having a molecular weight of from 150 to 2,500.

19. The neutralisation system as claimed in claim 15 in which in the restraining layer the hydrophilic segments are derived from two or more different poly alkylene glycols.

20. The neutralisation system as claimed in claim 15 in which in the restraining layer the hydrophobic segment is a bivalent alkylene, arylene or aralkylene radical.

21. The neutralisation system as claimed in claim 15 in which in the restraining layer the hydrophobic segment is the bivalent radical of a linear prepolymer selected from the group consisting of polyesters, polyurethanes, polyamides and polyureas, having a molecular weight of up to 10,000.

22. A photographic material for the production of colored images by the dye-diffusion process comprising:

(a) a first transparent layer support (b) a laminate arranged on said layer support, said laminate comprising in the following order, (i) an image-receiving layer, (ii) a light-reflecting layer and (iii) a photosensitive element containing at least one color unit comprised of a photosensitive silver halide emulsion layer and a dye-providing compound associated to said photosensitive layer (c) a neutralisation system arranged between said first transparent support and said laminate, said neutralisation system comprising an acid polymer layer and a restraining layer capable of retarding the diffusion of hydroxyl ions, said restraining layer being located between said acid polymer layer and said laminate, and (d) a rupturable container containing an alkaline processing solution and capable of discharging, on applying to it a compressive force, its content between said laminate, and a second transparent layer support, wherein the improvement comprises the restraining layer consists essentially of a film-forming linear polymer of a molecular weight of from 5,000 to 100,000 and the linear chain of the polymer is comprised of alternating hydrophilic polyether segments with a molecular weight of 150 to 20,000 in which three or more alkylene groups are separated by oxygen atoms, so that a maximum of four carbon atoms are present between two adjacent oxygen atoms and hydrophobic segments formed from bifunctional organic compounds containing two reactive groups capable of reacting with the terminal hydroxyl groups of polyether glycols to form connecting members selected from the group consisting of carbonate, urethane and ester connecting members, by removal of said reactive groups, said alternating hydrophilic and hydrophobic segments being joined to one another through connecting members selected from said carbonate, urethane and ester connecting members.

* * * * *